US006383249B2

(12) United States Patent
Bieniosek et al.

(10) Patent No.: US 6,383,249 B2
(45) Date of Patent: May 7, 2002

(54) MAGNESIUM DESULFURIZATION AGENT

(75) Inventors: Thomas H. Bieniosek, Litchfield; Gerald R. Zebrowski, Hudson, both of OH (US)

(73) Assignee: Rossborough Manufacturing Co. LP, Avon Lake, OH (US)

( * ) Notice: Subject to any disclaimer, the term of this patent is extended or adjusted under 35 U.S.C. 154(b) by 0 days.

(21) Appl. No.: 09/877,388

(22) Filed: Jun. 11, 2001

Related U.S. Application Data

(62) Division of application No. 09/546,016, filed on Apr. 10, 2000.

(51) Int. Cl.[7] ..... C21B 3/02

(52) U.S. Cl. ..... 75/312; 75/313; 75/314; 75/315; 75/560; 75/566; 75/567; 75/568; 420/23

(58) Field of Search ..... 420/22, 23, 24; 75/315, 316, 312, 566, 588, 10.47, 313, 314, 560

(56) References Cited

U.S. PATENT DOCUMENTS

| | | | |
|---|---|---|---|
| 2,873,188 A | | 2/1959 | Bieniosek |
| 3,598,573 A | | 8/1971 | Freissmuth et al. |
| 3,604,494 A | | 9/1971 | Trager et al. |
| 3,637,373 A | | 1/1972 | Bylund et al. |
| 3,876,421 A | | 4/1975 | Takemura |
| 3,929,464 A | | 12/1975 | Todd et al. |
| 3,955,973 A | | 5/1976 | Robinson |
| 3,998,625 A | | 12/1976 | Koros |
| 4,004,630 A | | 1/1977 | Dunks |
| 4,078,915 A | | 3/1978 | Meichsner et al. |
| 4,086,086 A | | 4/1978 | Dawson et al. |
| 4,137,072 A | | 1/1979 | Kawakami et al. |
| 4,139,369 A | | 2/1979 | Kandler et al. |
| 4,173,466 A | | 11/1979 | McLaughlin et al. |
| 4,194,902 A | | 3/1980 | Gmohling |
| 4,210,195 A | | 7/1980 | McPherson |
| 4,224,069 A | | 9/1980 | Shea et al. |
| 4,230,490 A | | 10/1980 | Kessl |
| 4,266,969 A | | 5/1981 | Koros |
| 4,313,758 A | | 2/1982 | Henning et al. |
| 4,315,773 A | | 2/1982 | Freissmuth et al. |
| 4,345,940 A | | 8/1982 | Koros |
| 4,385,030 A | | 5/1983 | Dremann |
| 4,395,282 A | | 7/1983 | Braun et al. |
| 4,540,436 A | | 9/1985 | Wolfsgruber et al. |
| 4,592,777 A | | 6/1986 | Rellermeyer et al. |
| 4,705,561 A | | 11/1987 | Green |
| 4,708,737 A | | 11/1987 | Skach, Jr. et al. |
| 4,764,211 A | | 8/1988 | Meichsner et al. |
| 4,765,830 A | | 8/1988 | Skach, Jr. et al. |
| 4,832,739 A | | 5/1989 | Meichsner et al. |
| 4,897,242 A | * | 1/1990 | Gut et al. ..... 420/23 |
| 4,900,375 A | | 2/1990 | Alt et al. |
| 4,943,317 A | | 7/1990 | Lischka et al. |
| 4,943,411 A | | 7/1990 | Henych et al. |
| 5,021,086 A | | 6/1991 | Luydkx et al. |
| 5,259,442 A | | 11/1993 | Clark |

FOREIGN PATENT DOCUMENTS

| | | |
|---|---|---|
| LU | 88252 | 1/1994 |

* cited by examiner

*Primary Examiner*—Melvyn Andrews
(74) *Attorney, Agent, or Firm*—Vickers, Daniels & Young

(57) ABSTRACT

A method and composition for removing sulfur from molten ferrous material, particularly molten pig iron. The desulfurization agent includes a magnesium particle coated with a heat absorbing compound. The heat absorbing compound absorbs heat around the magnesium particle to reduce the rate the magnesium particle vaporizes in the molten iron. The particle size of the magnesium particle is at least about twice the particle size of the heat absorbing compound. A bonding agent can be used to bond the particles of the heat absorbing compound to the particle of magnesium.

40 Claims, 9 Drawing Sheets

MAGNESIUM DESULFURIZATION AGENT

This patent application is a divisional patent application of co-pending U.S. patent application Ser. No. 09/546,016 filed Apr. 10, 2000, and incorporated herein by reference.

The present invention relates to a method of desulfurization of molten iron and more particularly to a desulfurization agent used to desulfurize molten pig iron.

BACKGROUND OF THE INVENTION

Specifications for the sulfur content of finished steel are decreasing to extremely low levels to make high strength low alloy steel, and steels resistant to hydrogen induced cracking, among other applications requiring low sulfur contents. In combination with the economic benefits of blast furnace operations producing molten pig iron with increased sulfur contents, the desulfurization of molten pig iron external to the blast furnace before the molten pig iron enters the steel making furnace has become a practical necessity. Over the years, a wide variety of materials and mixtures have been used to desulfurize pig-iron. It has long been known that various calcium compounds are good desulfurization agents. It has also been known that magnesium, alone or in combination with various alkaline metal oxides, is also a good desulfurization agent. There have been several patents which disclose the use of calcium oxide and magnesium as the primary desulfurization agents. (See Skach U.S. Pat. No. 4,765,830; Skach U.S. Pat. No. 4,708,737; Green U.S. Pat. No. 4,705,561; Kandler U.S. Pat. No. 4,139,369; Kawakami U.S. Pat. No. 4,137,072; Koros U.S. Pat. No. 3,998,625). Furthermore, desulfurization agents disclosing the use of calcium carbide as the primary desulfurization agent have also been known and well documented. (See Freissmuth U.S. Pat. No. 3,598,573; Todd U.S. Pat. No. 3,929,464; Braun U.S. Pat. No. 4,395,282).

The use of a desulfurization agent that includes magnesium and iron carbide or high carbon ferromanganese is disclosed in Luxemburg Patent No. 88,252 dated Jan. 3, 1999 and invented by Axel Thomas. The desulfurization agent disclosed in Thomas '252 includes a majority of iron carbide or high carbon ferromanganese. The desulfurization agent also includes magnesium, and one or more additives to improve the formed slag. The particles of iron carbide or high carbon ferromanganese are selected to be the same or slightly greater in size than the particles of magnesium. The particle sizes of the iron carbide or high carbon ferromanganese and magnesium range from 0.5 to 1 mm. As a result, the particles of iron carbide or high carbon ferromanganese do not coat the particles of magnesium, or vice versa. The iron carbide or high carbon ferromanganese and magnesium can be coated with titanium oxide to improve the fluidity of the particles and to slow the melting rate of the particles. The iron carbide or high carbon ferromanganese and magnesium can be mixed together prior to injection into the pig-iron or injected separately into the pig-iron.

The use of a calcium compound and/or magnesium, in combination with a gas-producing compound, has also been used to increase the amount of sulfur removal. It has been found that the gas-producing compound releases a gas upon contact with the molten pig-iron to create a turbulent environment within the molten pig-iron. The released gas primarily breaks down agglomerations of the desulfurization agent and disperses the desulfurization agent throughout the molten pig-iron. The gas-producing agent is typically a hydrocarbon, carbonate or alcohol which has a tendency to release various amounts of gas upon contact with the molten pig-iron. Use of these various gas-producing agents is well documented. (See Takmura U.S. Pat. No. 3,876,421; Meichsner U.S. Pat. No. 4,078,915; Gmohling U.S. Pat. No. 4,194,902; Koros U.S. Pat. No. 4,266,969; Freissmuth U.S. Pat. No. 4,315,773; Koros U.S. Pat. No. 4,345,940; Green U.S. Pat. No. 4,705,561; Rellermeyer U.S. Pat. No. 4,592,777; Meichsner U.S. Pat. No. 4,764,211; Meichsner U.S. Pat. No. 4,832,739; and Luyckx U.S. Pat. No. 5,021,086).

Desulfurization agents can contain various slag-forming agents. The importance of the slagging agent generally has been passed over for more immediate concerns about the economics of using various ingredients of the desulfurization agent. The composition of the slag can be important to retain the removed sulfur within the slag and not allow the sulfur to re-enter the molten pig-iron. Various slagging agents have been used for various purposes. In U.S. Pat. No. 4,315,773 a desulfurization agent comprising calcium carbide, a gas-involving compound, and fluorspar is disclosed. Fluorspar is used to modify the properties of the slag to prevent carbon dust production from igniting during the desulfurization. In U.S. Pat. No. 5,021,086, fluorspars are used to modify the characteristics of the slag increasing the fluidity of the slag during the desulfurization process.

There is a critical need to maximize sulfur removal in the pig iron at the lowest possible cost. Although magnesium is an excellent desulfurizer due to its very high reactivity with sulfur, much of the magnesium in the pig iron immediately vaporizes on contact with the pig iron and rapidly escapes from the pig iron by bubbling to the surface of the pig iron, allowing very little time for reacting with sulfur. Magnesium must dissolve into pig iron, forming a solution, in order for it to react efficiently with sulfur. Since magnesium is one of the more costly components of a desulfurization agent, various desulfurization agents have been developed to remove sulfur from the pig iron using components other than magnesium, such as calcium oxide and calcium carbide, as the principal desulfurizer, to reduce the cost of the desulfurization agent. Larger quantities of these desulfurization agents, in comparison to magnesium, are needed to remove sulfur in the pig iron, thus driving up the cost of the desulfurization process. In addition, the use of large quantities of desulfurization agent results in large slag formation which in turn results in a significant loss of iron in the slag. The loss of iron in the slag results in higher costs associated with the desulfurization process. As a result, there remains a need in the steel industry to desulfurize pig iron in an efficient and cost effective manner and to reduce the loss of iron during the desulfurization process.

SUMMARY OF THE INVENTION

The present invention relates to an improved desulfurization agent and a method of treating molten ferrous materials such as molten pig iron with a desulfurization agent that improves desulfurization efficiency.

In accordance with the principal feature of the present invention, there is provided a desulfurization agent which includes a reactive desulfurizing agent that actively reacts with sulfur in the molten iron, such as molten pig iron. Preferably, the reactive desulfurizing agent forms a compound with the sulfur that can be removed from the molten pig iron, such as migrating into a slag on the surface or to the bottom of the molten pig iron and/or forming into a gas and bubbling out of the molten pig iron. The reactive desulfurizing agent is at least partially coated with a heat absorbing agent. The heat absorbing compound is formulated to absorb heat around the reactive desulfurizing agent.

In one embodiment, the heat absorbing compound is formulated to absorb heat about and/or closely adjacent to the reactive desulfurizing agent to increase the time the reactive desulfurization agent remains in the molten pig iron for reaction with sulfur and/or to increase the reaction rate of the reactive desulfurizing agent.

In accordance with one aspect of the present invention, the reactive desulfurization agent is partially or totally coated with the heat absorbing agent. The reactive desulfurization agent can be pre-coated with the heat absorbing mixture or coated with the heat absorbing mixture just prior to being added to the molten pig iron. In one specific aspect of the invention, a reactive desulfurization agent is sufficiently coated with the heat absorbing compound to reduce the rate of or prevent the vaporization of the reactive desulfurization agent prior to the reactive desulfurization agent reacting with a significant amount of sulfur in the pig iron.

In accordance with another aspect of the present invention, the reactive desulfurizing agent is a solid material at least at ambient temperature (i.e. 70° F.). The reactive desulfurizing agent can be made of a single material or a plurality of materials. Preferably, the reactive desulfurizing agent is selected to maintain its solid form until at least just prior to being combined with the molten iron, such as molten pig iron. The reactive desulfurizing agent is also selected to react with and/or remove sulfur from the iron. The reactive desulfurizing agent is further selected to minimize the introduction of undesired materials, such as sulfur, into the pig iron during the desulfurization process. In one specific aspect of the present invention, the reactive desulfurizing agent is a magnesium agent that includes magnesium, a magnesium alloy and/or a magnesium compound. In another specific embodiment, the magnesium agent is composed primarily of magnesium metal. As can be appreciated, other or additional reactive desulfurizing agents can be used, such as, but not limited to, calcium, calcium oxide, and/or calcium carbide.

In accordance with still another aspect of the present invention, the weight percentage of the reactive desulfurizing agent that is coated with the heat absorbing compound particles is greater than the weight percentage of the particles of the heat absorbing compound that are directly on said reactive desulfurizing agent particle. Preferably, the particle size of the reactive desulfurizing agent is also larger than the average particle size of the heat absorbing compound. In one preferred embodiment, the average particle size of the reactive desulfurizing agent which is coated is at least two times greater than the average particle size of the heat absorbing compound that is coated onto a particle of reactive desulfurizing agent. In one specific embodiment, the average particle size of the reactive desulfurizing agent is about 2–1000 times the maximum particle size of the heat absorbing compound. In one embodiment, the average particle size of the reactive desulfurizing agent is up to about 1.5 mm, and preferably about 0.2–1 mm, and more preferably about 0.5–1 mm. In another embodiment, the average particle size of the heat absorbing compound use to coat the particles of reactive desulfurizing agent are up to about 0.5 mm, and preferably up to about 0.25 mm, and more preferably up to about 0.18 mm, even more preferably up to about 0.15 mm, and still even more preferably up to about 0.11 mm. In still another embodiment, the average weight percentage of the reactive desulfurizing particle which is coated with particles of the heat absorbing compound is about 50–99 weight percent of the sum of the weights of the desulfurizing agent and heat absorbing compound. As can be appreciated, the reactive desulfurizing agent particle can be partially coated or completely coated with particles of the heat absorbing compound. When the reactive desulfurizing agent particle is only partially coated at least about 10 percent, and preferably the majority of the surface of the reactive desulfurizing agent particle is covered. Preferably, the heat absorbing compound constitutes at least about 1 weight percent of the coated particle, more preferably, at least about 2 weight percent, and even more preferably, about 2–30 weight percent. The particles of heat absorbing compound can form a blend and/or conglomeration with a single or a plurality of reactive desulfurizing agent particles. In such blends and/or conglomerations, the weight percentage of the heat absorbing compound can be greater than the weight percentage of the heat absorbing compound on non-conglomerated coated reactive desulfurizing agent particles. The weight percentage of the heat absorbing compound particles of a conglomeration can be up to about 70 weight percent.

In accordance with still yet another aspect of the present invention, the heat absorbing compound includes solid carbide compounds and/or ferroalloys. The carbide compound and/or ferroalloy is preferably solid at ambient temperature, and more preferably remains solid at least until just prior to being combined with the molten iron, such as molten pig-iron. The carbide compound and/or ferroalloy is selected to absorb heat away from the reactive desulfurizing agent to thereby increase the residence time of the reactive desulfurizing agent in the molten pig-iron. The carbide compound and/or ferroalloy can also act as a catalyst for the sulfur reactions between the sulfur and the reactive desulfurizing agent. Preferably the carbide compound and/or ferroalloy has a higher melting point than the reactive desulfurizing agent. In another embodiment, the carbide compound and/or ferroalloy endothermically reacts and/or disassociates in the molten pig iron thereby absorbing heat. The higher melting temperature carbide compound and/or ferroalloy and/or endothermically reacting and/or disassociating carbide compound and/or ferroalloy draws and/or absorbs heat around the carbide compound and/or ferroalloy. The heat absorbing feature of the heat absorbing compound results in a reduced amount of heat affecting the coated reactive desulfurizing agent particle for a period of time. This period of time of reduced heat reduces the rate the reactive desulfurizing agent vaporizes and bubbles out of the molten pig iron. When the reactive desulfurizing agent is or includes a magnesium agent, the heat absorbing compound works to increase the residence time of the magnesium in the molten pig iron, allowing the magnesium to dissolve into the molten pig iron, so that the magnesium is able to continue to react with the sulfur in the molten pig iron. The longer the magnesium remains in solid or liquid form in the molten pig iron, the higher the desulfurization efficiency of the magnesium. The molten pig iron has a temperature of at least 1140° C. Magnesium has a melting point of about 649° C. and a boiling point of about 1107° C. The heat absorbing compound is formulated to reduce the rate of melting of the reactive desulfurization agent, such as magnesium, in the coated particle and the rate at which reactive desulfurization agent begins to boil and ultimately vaporizes. It has been found that the heat absorbing compound can reduce the temperature around the reactive desulfurizing agent to at least the boiling point of magnesium for a period of time. The reduced temperature around the reactive desulfurizing agent particle occurs even after the heat absorbing material has disassociated itself from the surface of the reactive desulfurizing agent particle. The reduced temperature is a result of the heat absorbing material absorbing heat from the surrounding liquid pig iron, thereby resulting in a reduced temperature environment in close proximity to the heat absorbing compound. When carbide compounds and/or ferroalloys are used as or part of the heat absorbing compound, these preferably include, but are not limited to, iron carbide and/or high carbon ferromanganese.

In accordance with a further aspect of the present invention, the particles of heat absorbing compound are at least partially bonded to the particle surface of the reactive desulfurizing agent by a bonding agent. The bonding agent can also assist in the flowability of the coated reactive desulfurizing agent particle. The bonding agent can include a number of compounds that can assist in the bonding of the heat absorbing compound particles to the surface of the reactive desulfurizing agent particle and/or form blends and/or conglomerations of heat absorbing particles and reactive desulfurizing agent particles. In one embodiment, the bonding agent is selected so as to not introduce adverse materials to the pig iron, such as sulfur. The bonding agent can include, but is not limited to, polyhydric alcohols, polyhydric alcohol derivatives, and/or silicon compounds.

In accordance with another aspect of the present invention, the pig iron is shielded from the atmosphere during the desulfurization process. In one embodiment, the shielding takes the form of creating an inert and/or non-oxidizing environment about the molten pig iron. The inert and/or non-oxidizing environment can be formed by placing the pig iron in a chamber filled with inert and/or non-oxidizing gas and/or by flowing an inert and/or non-oxidizing gas over the top of the pig iron during desulfurization. The inert and/or non-oxidizing environment inhibits or prevents oxygen from contacting the pig iron and oxidizing various components of the desulfurization agent and/or from reacting with the pig iron during desulfurization. Inert and/or non-oxidizing gases, which can be used to form the inert and/or non-oxidizing environment include, but are not limited to, helium, nitrogen, argon, and natural gas.

In accordance with yet another aspect of the present invention, a calcium compound is added with the coated reactive desulfurizing agent to assist in the removal of sulfur from the pig iron. The calcium compound is selected to react with sulfur in the molten pig iron. Various calcium compounds can be used such as, but not limited to, calcium oxide, calcium carbide, calcium carbonate, calcium chloride, calcium cyanamide, calcium iodide, calcium nitrate, diamide lime, and calcium nitrite. In one embodiment, the calcium compound disassociates and the calcium ion forms in the molten pig iron so as to be available to react with the sulfur. The calcium compound may or may not have a melting point which is less than the temperature of the molten pig iron. In another embodiment, the calcium compound is selected such that the ions previously associated with the calcium ion do not adversely affect the desulfurization process. When a calcium compound is used in the desulfurization agent, the calcium compound preferably includes calcium oxide, calcium carbonate, and/or calcium carbide. In still another embodiment, the particle size of calcium compounds is selected to provide the necessary reactivity or activity of the calcium compound with the sulfur in the pig iron. When the particle size is too large, fewer calcium ions will be produced, resulting in poorer desulfurization efficiencies. In one specific embodiment, the particle size of the calcium compound is maintained at less than about 0.18 mm (80 mesh).

In accordance with yet anther aspect of the present invention, a carbide compound is added with the coated reactive desulfurizing agent to assist in the removal of sulfur from the pig iron. The carbide compound can be the same as, include, or be a different compound from heat absorbing compound that is coated onto the surface of the reactive desulfurizing agent particle. When a non-coated carbide is used, the particles of carbide have a size of up to about 1.5 mm, and preferably less than about 0.18 mm (80 mesh).

In accordance with still a further aspect of the present invention, a gas is added with the coated reactive desulfurizing agent to assist in the mixing and dispersion of the desulfurization agent in the molten pig-iron. This mixing action can result in increased sulfur reaction rates in the molten pig iron. In one embodiment, the gas is formed from a gas producing compound. In one specific embodiment, the gas-producing compound is chosen such that gas is produced upon contact with the molten pig iron. The produced gas mixes the various components of the desulfurization reagent in the pig iron to increase the desulfurization efficiency of the desulfurization agent. The gas disperses the desulfurization agents so as to maximize the active sites available for reaction with the sulfur, thereby further increasing the efficiency of sulfur removal from the pig iron. The gas added into the pig iron and/or the gas from the gas-producing compound preferably are not detrimental to the desulfurization process and/or the environment about the desulfurization process. In one specific embodiment, the gas-producing component is a solid compound at ambient temperature. Gas producing compounds which can be used include, but are not limited to, coal, plastic, rubber, solid hydrocarbons, solid alcohols, solid nitrogen containing compounds, solid esters and/or solid ethers.

In accordance with still yet another aspect of the present invention, a slag-improvement agent is added with the coated reactive desulfurizing agent to generate a more fluid slag and/or to reduce the amount of liquid pig iron entrapped within the slag. Various slag-improvement agents can be used such as, but not limited to, metallurgical and/or acid grade fluorspar, dolomitic lime, silica, sodium carbonate, sodium chloride, potassium chloride, potash, cryolite, potassium cryolite, colemanite, calcium chloride, calcium aluminate, sodium fluoride, anhydrous borax, nepheline syenite, and/or soda ash. In one embodiment, a metallurgical and/or acid grade fluorspar is used such as, but not limited to, calcium fluoride. Metallurgical and/or acid grade fluorspar causes desired modifications to the physical properties of the slag. The amount of slag-improvement agent is a selected to improve the slag characteristics without unduly reducing the viscosity of the slag whereby the sulfur can easily transfer back into the molten pig iron.

In accordance with another aspect of the present invention, the desulfurization agent is injected beneath the surface of the molten iron, such as pig iron. The desulfurization agent can be injected such that the coated reactive desulfurizing agent is injected by itself into the pig iron, injected with other components of the desulfurization agent, or co-injected with other components of the desulfurization agent. In one embodiment, the components of the desulfurization agent are fluidized prior to being injected into the molten pig iron. In one specific embodiment, the desulfurization components are fluidized in a semi-dense state before being injected into the pig iron. The fluidized desulfurization agent is carried into the pig iron by a carrier gas. In another specific embodiment, the carrier gas is inert and/or non-oxidizing to the components of the desulfurization agent. Carrier gases that can be used are, but not limited to, argon, nitrogen, helium, natural gas or various other inert and/or non-oxidizing gases.

The primary object of the present invention is to provide a desulfurization agent that increases the efficiency of desulfurization of iron.

Another object of the present invention is the provision of a desulfurization agent which forms a slag that retains sulfur compounds formed during desulfurization.

Still another object of the present invention is the provision of a desulfurization agent that includes a reactive desulfurizing agent to remove sulfur from the iron, such as pig iron.

Yet another object of the present invention is the provision of a desulfurization agent which includes a heat absorbing compound that reduces the rate of vaporization of the reactive desulfurizing agent in the molten pig iron.

Still yet another object of the present invention is the provision of a desulfurization agent which includes particles of reactive desulfurizing agent coated with particles of a heat absorbing agent.

Another object of the present invention is the provision of a desulfurization agent wherein the size of the reactive desulfurizing agent particles are substantially larger than the size of the heat absorbing particles coated to the surface of the reactive desulfurizing agent particle.

A further object of the present invention is the provision of a desulfurization agent wherein a heat absorbing particle used to coat the surface of a reactive desulfurizing agent particle includes a carbide and/or ferroalloy with a melting point below the temperature of the molten pig iron being treated.

Still another object of the present invention is the provision of a desulfurization agent wherein the weight of the reactive desulfurizing agent particle is substantially greater than the weight of the heat absorbing particles coated to the surface of the reactive desulfurizing agent particle.

Yet another object of the present invention is the provision of a desulfurization agent which includes a bonding agent to bond heat absorbing particles to the surface of a reactive desulfurizing agent particle.

Still yet another object of the present invention is the provision of a desulfurization agent which includes a gas producing or volatile producing compound that releases a gas when in contact with molten pig iron.

Another object of the present invention is the provision of a desulfurization agent which includes a calcium and/or carbide compound to remove sulfur from the pig iron.

Still yet another object of the present invention is the provision of a desulfurization agent which includes a slag-improvement agent to improve the slag characteristics of the slag on the surface of the pig iron.

A further object of the present invention is the provision of a desulfurization agent which is injected beneath the surface of the pig iron.

These and other objects of the invention will become apparent to those skilled in the art upon reading and understanding the following detailed description of preferred embodiments taken together with the drawings.

BRIEF DESCRIPTION OF THE DRAWINGS

The invention may take physical form in certain parts and arrangement of parts, preferred embodiments of which will be described in detail and illustrated in the accompanying drawings which form a part hereof and wherein.

DESCRIPTION OF THE PREFERRED EMBODIMENTS

Figure 1:
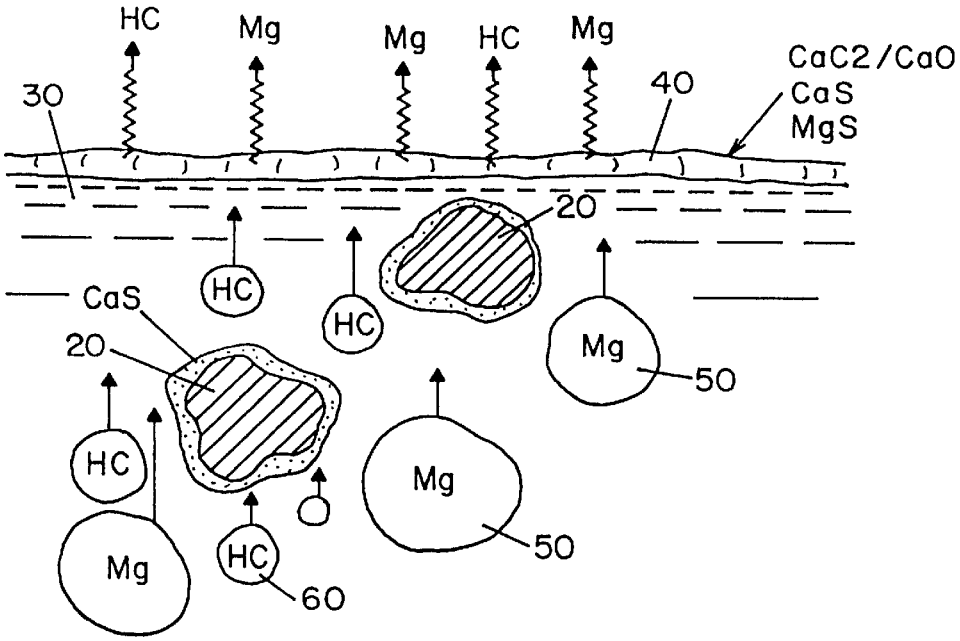
FIG. 1 (PRIOR ART)
FIG. 1 is a pictorial view illustrating a prior art desulfurization agent in the molten pig iron which desulfurization agent includes calcium compound, a hydrocarbon volatile and magnesium.

Referring to the drawings, wherein the showings are for the purpose of illustrating the preferred embodiment of the invention only and not for the purpose of limiting same, FIG. 1 illustrates a prior art desulfurization agent, such as one disclosed in Koros U.S. Pat. No. 4,345,940, used to remove sulfur from molten iron. The desulfurization agent is a combination of calcium compound such as calcium oxide (CaO) and/or calcium carbide ($CaC_2$) particles 20, a hydrocarbon volatile (HC), and magnesium (Mg). The calcium compound particles 20 reacts with sulfur in the iron 30 to form calcium sulfide in the slag layer 40. Preferably, molten iron 30 is pig iron; however, the molten iron can be other types of iron. The particles of calcium compound 20 which do not react with sulfur migrate into the slag lager 40. The magnesium and hydrocarbon volatile immediately vaporize upon contact with the molten pig iron 30 to form magnesium vapor bubbles 50 and hydrogen and/or hydrocarbon bubbles 60. Bubbles 50 and 60 create turbulence in the pig iron as the bubbles migrate up through the pig iron and through the slag layer 40. The turbulence caused by the bubbles increases the sulfur removal efficiency by the desulfurization agents 20. The residence time of the magnesium in the molten pig iron is very short due to the immediate vaporization of the magnesium in the pig iron 30. Since magnesium must first dissolve into the pig iron before it can remove significant amounts of sulfur, much of the magnesium does not react with sulfur in the pig iron 30.

Figure 2:
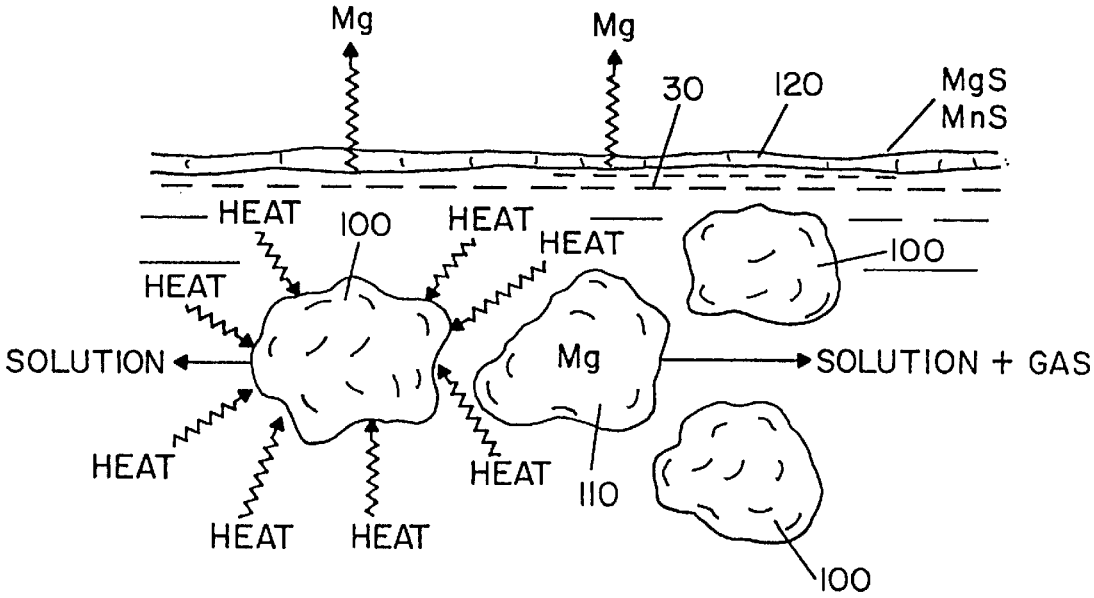
FIG. 2 (PRIOR ART)
FIG. 2 is a pictorial view illustrating a prior art desulfurization agent in molten pig-iron which desulfurization agent includes ferromanganese and magnesium.

FIG. 2 illustrates another prior art desulfurization agent which is disclosed in Luxemburg Patent No. 88,252. The desulfurization agent is made of ferromanganese particles 100 and magnesium particles 110. Both the ferromanganese and magnesium serve to remove sulfur from the pig iron 30. The magnesium is also used to create turbulence in the molten pig iron 30. The principal component of the desulfurization agent 100 is iron carbide and/or ferromanganese and constitutes a majority of the desulfurization agent. The particles of ferromanganese 100 are the same as or slightly greater in size than the particles of magnesium 110. As a result, the ferromanganese 100 does not coat the magnesium 110 or vice versa. As shown, the ferromanganese reacts with the sulfur in the molten pig iron 30 to form manganese sulfide in the slag 120. The slag 120 will also include unreacted ferromanganese 100. As the ferromanganese particles melt in the molten pig iron, they absorb heat from the bath. This heat absorption results in the immediate area about the ferromanganese particles 100 being slightly cooler. Therefore, particles of magnesium 110 that are in very close proximity to ferromanganese 100 in the molten pig iron 30 will be exposed to a less heated environment. Although these select magnesium particles are exposed to a less heated environment, a significant amount of magnesium still vaporizes and escapes through the slag 120 without reacting with sulfur in the molten pig iron 30.

Figure 3:
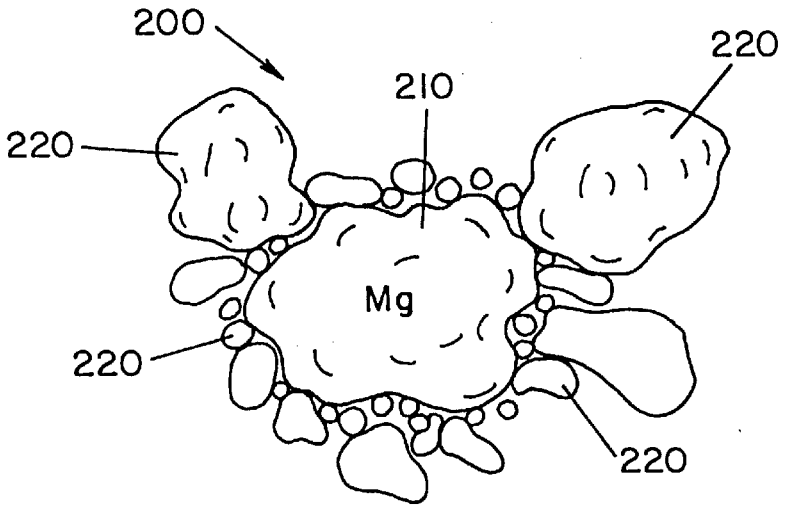
FIG. 3 is a pictorial view illustrating the desulfurization agent of the present invention wherein a particle of magnesium is coated with iron carbide and/or high carbon ferromanganese.

Referring now to FIG. 3, there is illustrated a desulfurizing agent 200 which is formed of a reactive desulfurizing agent of magnesium particles 210 and a heat absorbing agent of high carbon ferromanganese and/or iron carbide particles 220. However, the heat absorbing agent can include, or be an element or compound other than high carbon ferromanganese and/or iron carbide. In the description of this one preferred embodiment, the reactive desulfurizing agent will be a magnesium particle 210 and the heat absorbing agent will be high carbon ferromanganese and/or iron carbide 220.

The desulfurization agent 200 is formed by coating magnesium particle 210 with high carbon ferromanganese and/or iron carbide particles 220. The magnesium particle 210 is generally pure magnesium, but can include or be in the alternative an alloy of magnesium and/or a magnesium compound. The particles of high carbon ferromanganese and/or iron carbide coat the outer surface of the magnesium particle. As can be appreciated, the magnesium particle can be coated with high carbon ferromanganese and/or iron carbide. As illustrated in FIG. 3, the size of the coating particles is smaller than the size of the magnesium particle. Preferably, the average particle size of the magnesium is at least two times greater that the maximum particle size of the coating particles. The average particle size of the of the magnesium particle can vary in size up to about 1.5 mm. The average particle size of the coating particles varies in size up to about 0.5 mm. The magnesium particle constitutes at least 50 percent of the desulfurization agent. The weight percentage of the coating is about 2–50 weight percent.

Figure 4A:
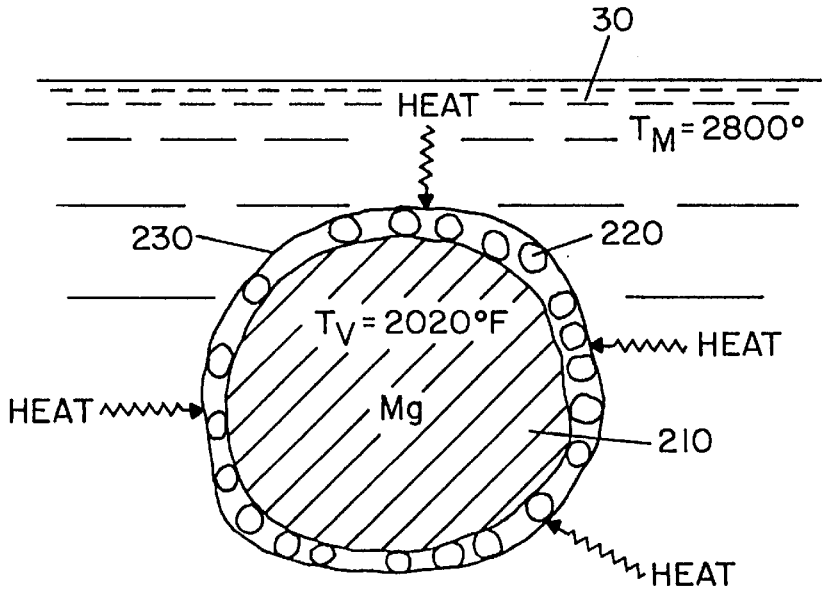
FIG. 4A is a pictorial view illustrating the temperature surrounding a particle of coated magnesium in molten pig iron.
Figure 4B:
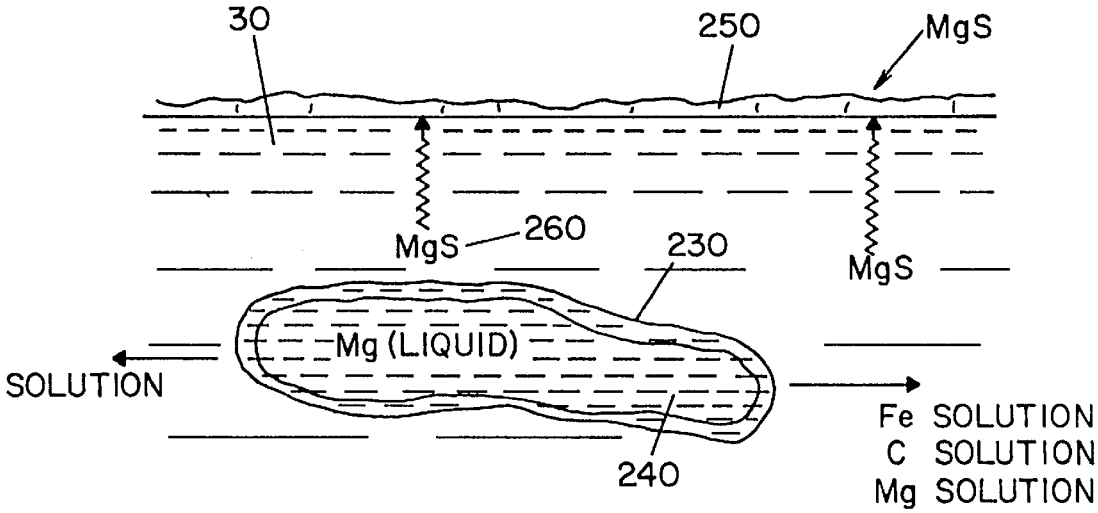
FIG. 4B is a pictorial view illustrating the reaction of the desulfurization agent of the present invention in molten pig iron.

Referring now to FIGS. 4A and 4B, the magnesium particle 210 is coated with a heat absorbing compound 220, such as iron carbide and/or high carbon ferromanganese, to reduce the rate at which magnesium particle 210 vaporizes in the molten pig-iron 30. As illustrated in FIG. 4A, the heat absorbing compound absorbs heat thereby reducing, for a period of time, the temperature or amount of heat the magnesium particle is exposed to in the molten pig iron 30. The molten pig iron 30 is maintained above the melting point of pig iron and generally at a temperature of about 2200–2650° F. As shown in FIG. 4A, the heat absorbing compound forms a pseudo heat shield 230 about the magnesium particle such that the temperature the magnesium particle is exposed to for a period of time is less than or about equal to the boiling point of magnesium. The pseudo heat shield 230 formed by the heat absorbing compound allows the magnesium to remain in liquid form 240 as shown in FIG. 4B. As a result, the magnesium is maintained in a liquid form for a longer time to allow the magnesium to dissolve into the molten iron and react with the dissolved sulfur in the molten pig iron, forming magnesium sulfide, which rises to the surface of the molten pig iron to form slag 250. As shown in FIG. 4B, the heat absorbing compound is iron carbide and/or high carbon ferromanganese. The iron carbide and/or high carbon ferromanganese, when exposed to the molten pig iron, dissolve and/or dissociate into solution. As the particles dissolve, the particles absorb heat about the particles. The dissociation of the iron carbide in the iron is an endothermic reaction, thus absorbing heat. This heat absorbing mechanism in combination with the coated particle layer forms the pseudo heat shield about the magnesium particle. The magnesium, being a highly reactive element with sulfur, rapidly forms magnesium sulfide 260 when the magnesium is dissolved in the molten pig iron. The formed magnesium sulfide rises to the slag layer 250.

Figure 5A:
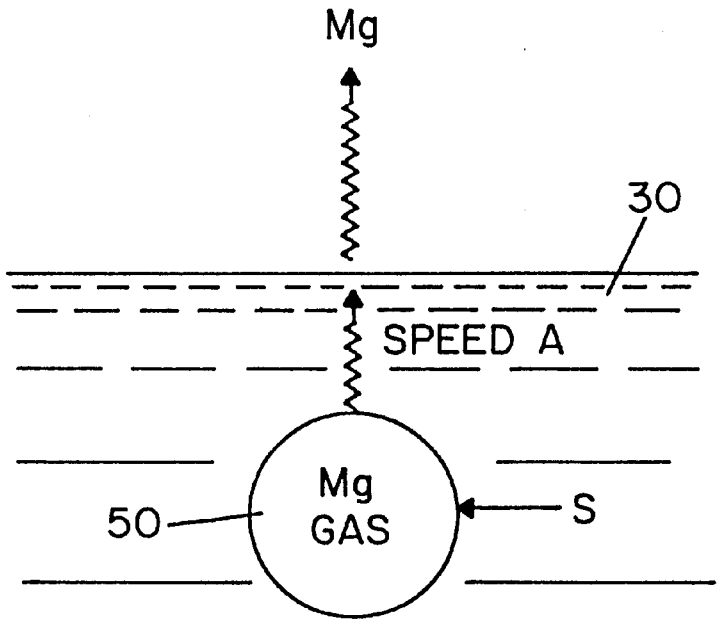
FIG. 5A (PRIOR ART)
FIG. 5A is a pictorial view illustrating the activity of magnesium of a prior art desulfurization agent in molten pig iron.
Figure 5B:
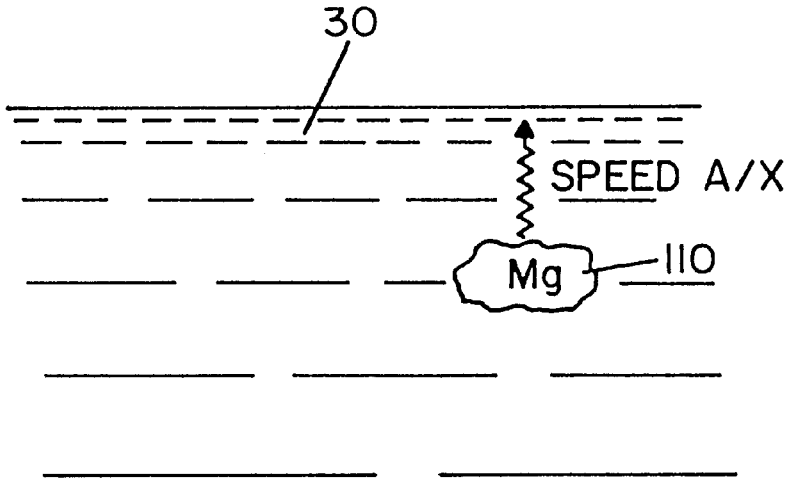
FIG. 5B is a pictorial view illustrating the activity of magnesium of the desulfurization agent of the present invention in molten pig iron.

An illustrative comparison of the residence time of the magnesium in prior art desulfurization agents and the magnesium in the desulfurization agent of the present invention is illustrated in FIGS. 5A and 5B. FIG. 5A illustrates a magnesium particle in the molten pig iron that has immediately vaporized and formed in a gas bubble. Once the magnesium particle is vaporized into a gas, the gas bubble rapidly travels at speed A out of the pig iron. The time it takes the magnesium to vaporize in the pig iron and bubble out of the pig iron is very short. FIG. 5B illustrates the magnesium particle having a longer residence time A/X in the molten pig iron. The longer residence time allows the highly reactive magnesium to dissolve into the molten pig iron and to react with sulfur in the molten pig iron to form magnesium sulfide.

Figure 6:
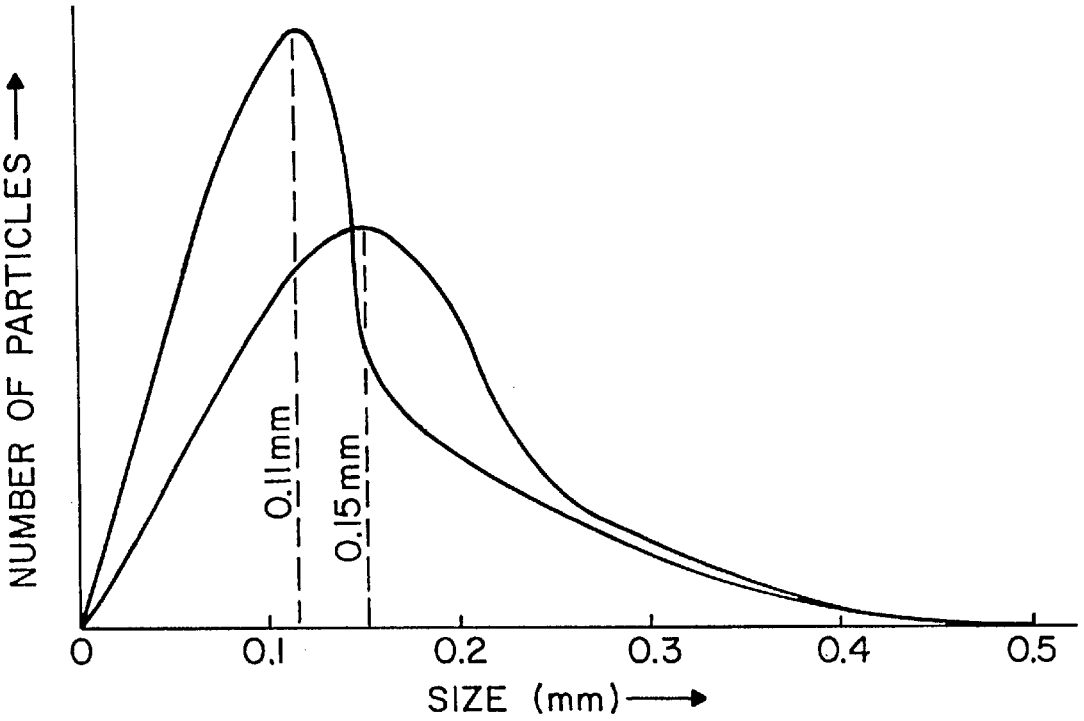
FIG. 6 is a graph illustrating the number of particles coated on a particle of a magnesium agent as a function of the particle size of the coating agent.

The size of the particles of the heat absorbing compound on the surface of the magnesium particle are important to form the coating on the surface of the magnesium particle. Particles that are too large cannot coat the surface of the magnesium or attach themselves to the magnesium particle surface to create the pseudo heat shield. Very fine particles have been found to form better bonding and a better heat shielding effect. As the average size of the particles of the heat absorbing compound decreases, a larger number of particles are used to coat the surface of the magnesium particle. This phenomenon is illustrated in FIG. 6. As shown in FIG. 6, a larger number of particles having an average size of 0.1 mm coat the surface of the magnesium particle than particles having an average size of 0.15 mm. The average particle size of the heat absorbing compound is preferably less than about 0.18 mm, preferably less than about 0.15 mm and even more preferably less than about 0.11 mm.

Figure 7A:
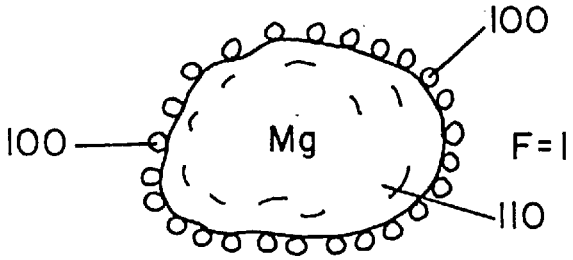
FIG. 7A is a pictorial view illustrating the desulfurization agent of the present invention wherein the particle of magnesium is totally coated with a heat absorbing compound.
Figure 7B:
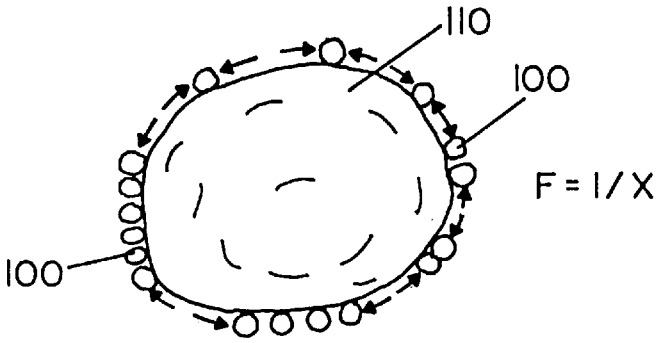
FIG. 7B is a pictorial view illustrating the desulfurization agent of the present invention wherein the particle of magnesium is partially coated with a heat absorbing compound.
Figure 7C:
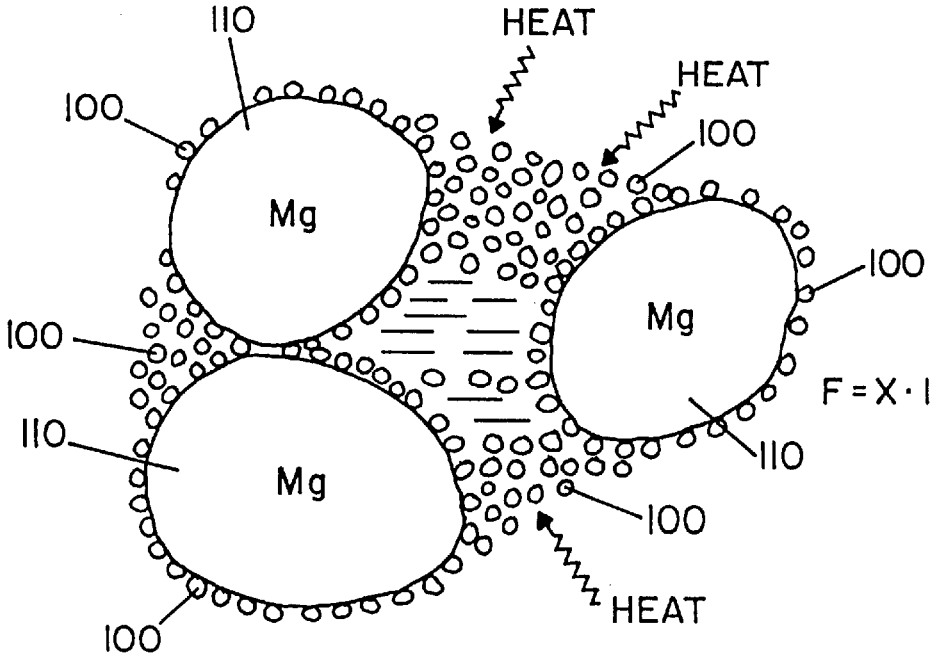
FIG. 7C is a pictorial view illustrating the desulfurization agent of the present invention wherein a plurality of particles of magnesium are blended and/or conglomerated with a heat absorbing compound.

Referring now to FIGS. 7A–7C, the amount of heat absorbing compound can be varied on the magnesium particle. In FIG. 7A, the heat absorbing compound particles 100 coated essentially the complete surface of the magnesium particle 110. FIG. 7B illustrates the heat absorbing compound particles 100 only partially coating the surface of the magnesium particle 110. Preferably, the magnesium particle is at least 10 percent coated by the heat absorbing compound particles. FIG. 7C illustrates the heat absorbing compound particles forming a blend and/or conglomeration with a plurality of magnesium particles.

Figure 8:
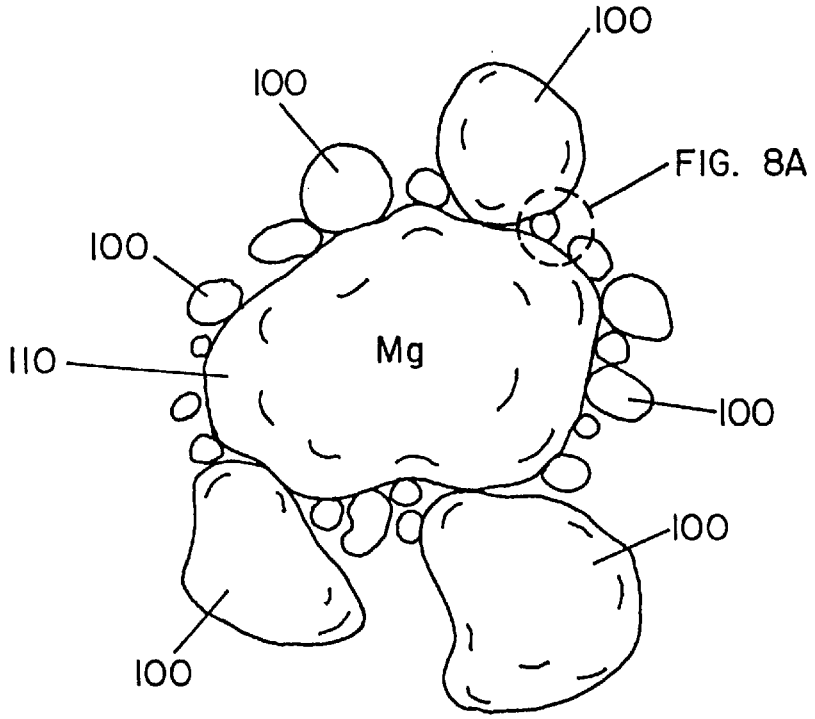
FIG. 8 is a pictorial view illustrating a particle of the desulfurization agent of the present invention.
Figure 8A:
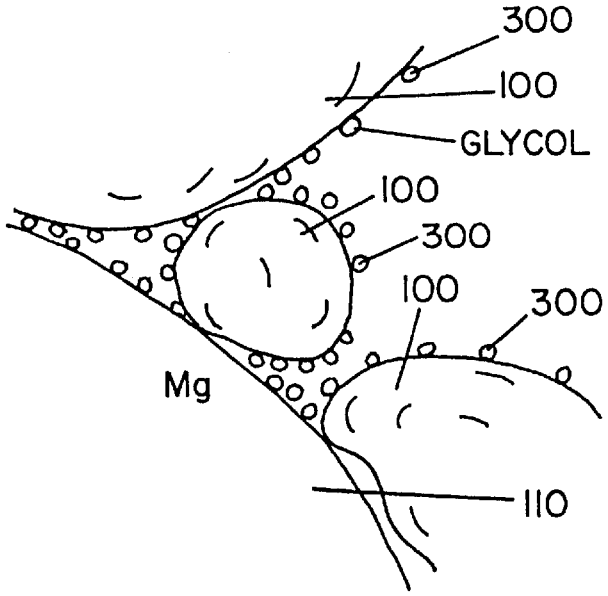
FIG. 8A is an enlarged pictorial view of the particle of desulfurization agent of FIG. 8.

Referring now to FIGS. 8 and 8A, an alternate embodiment of the desulfurization agent is shown wherein the heat absorbing compound particles 100 are bonded to the surface of the magnesium particle 110 by a bonding agent 300. The bonding agent can include a number of compounds that can assist in the bonding of the heat absorbing compound particles to the surface of the magnesium agent particle and/or form conglomerations of heat absorbing particle and magnesium agent particles. The bonding agent can also assist in the flowability of the coated magnesium agent particle when being injected into the molten pig iron. The bonding agent can include, but is not limited to, polyhydric alcohols, their derivatives, and/or silicon compounds; however, other binders can be used. As shown in FIG. 8A, the bond agent includes glycol.

Figure 9:
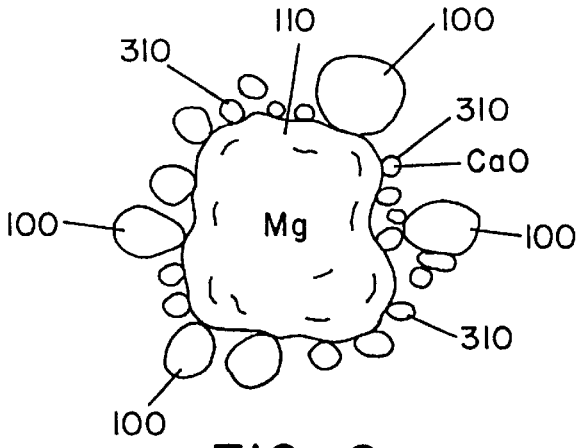
FIG. 9 is a pictorial view illustrating a particle of the desulfurization agent of the present invention wherein a particle of magnesium is coated with a carbide and calcium oxide.

Referring now to FIG. 9, another embodiment of the desulfurization agent is shown wherein a calcium desulfurization compound 310, such as calcium oxide, is coated with the heat absorbing compound particles 100 onto the surface of the magnesium particle 110. As can be appreciated, other or additional compounds or elements can be coated onto the magnesium particle to assist in sulfur removal, and/or to improve the slag. These particles include slag improvement agents, volatile producing compounds and the like. All or some of the coated particles can be bonded to the magnesium particle by a bonding agent.

Figure 10:
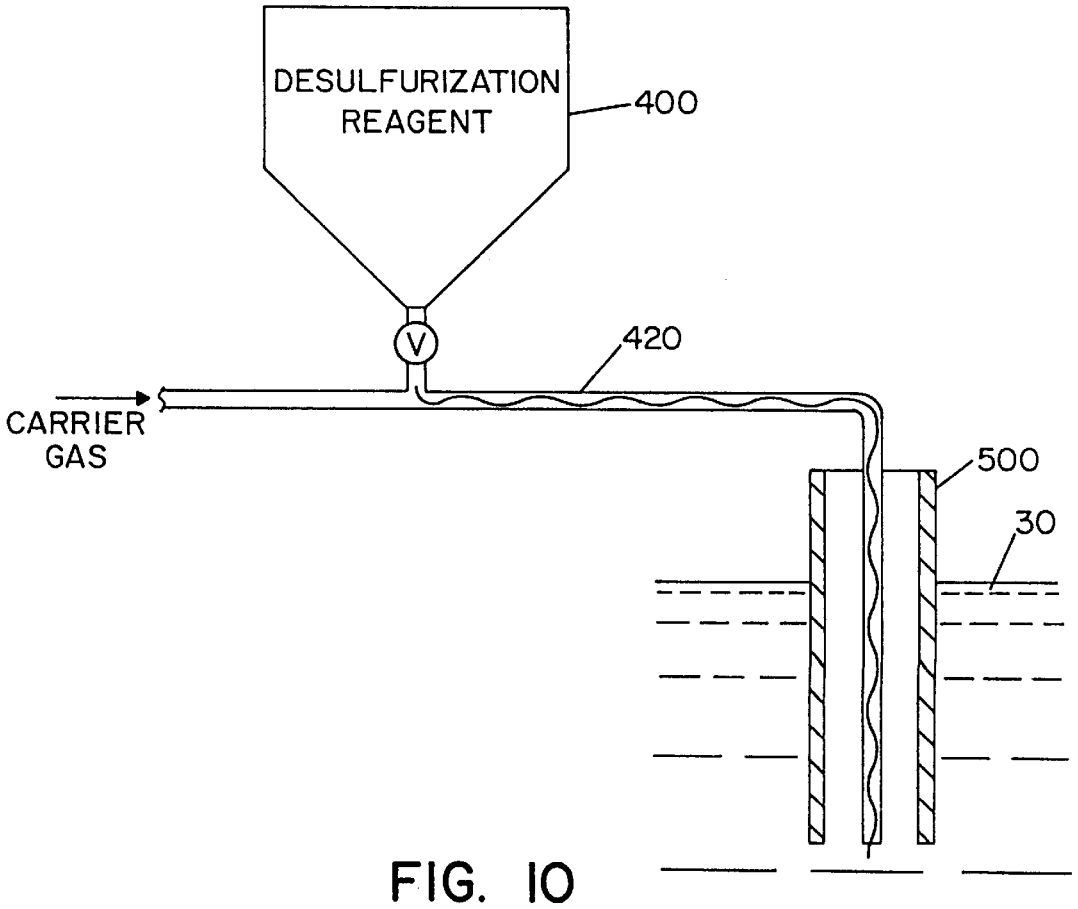
FIG. 10 is a pictorial view illustrating the desulfurization agent of the present invention being injected into molten pig iron.

FIG. 10 illustrates one process by which the desulfurization agent can be injected into the molten pig iron 30. In FIG. 10, vessel 400 contains a mixture of lime and/or calcium carbide particles and particles of magnesium coated with iron carbide and/or high carbon ferromanganese particles. This mixture in vessel 400 enters line 420, where it is conveyed to the lance 500 by a carrier gas, and are then injected into the molten pig iron 30. As can be appreciated, vessel 400 may only contain magnesium coated with iron carbide and/or high carbon ferromanganese.

Figure 11:
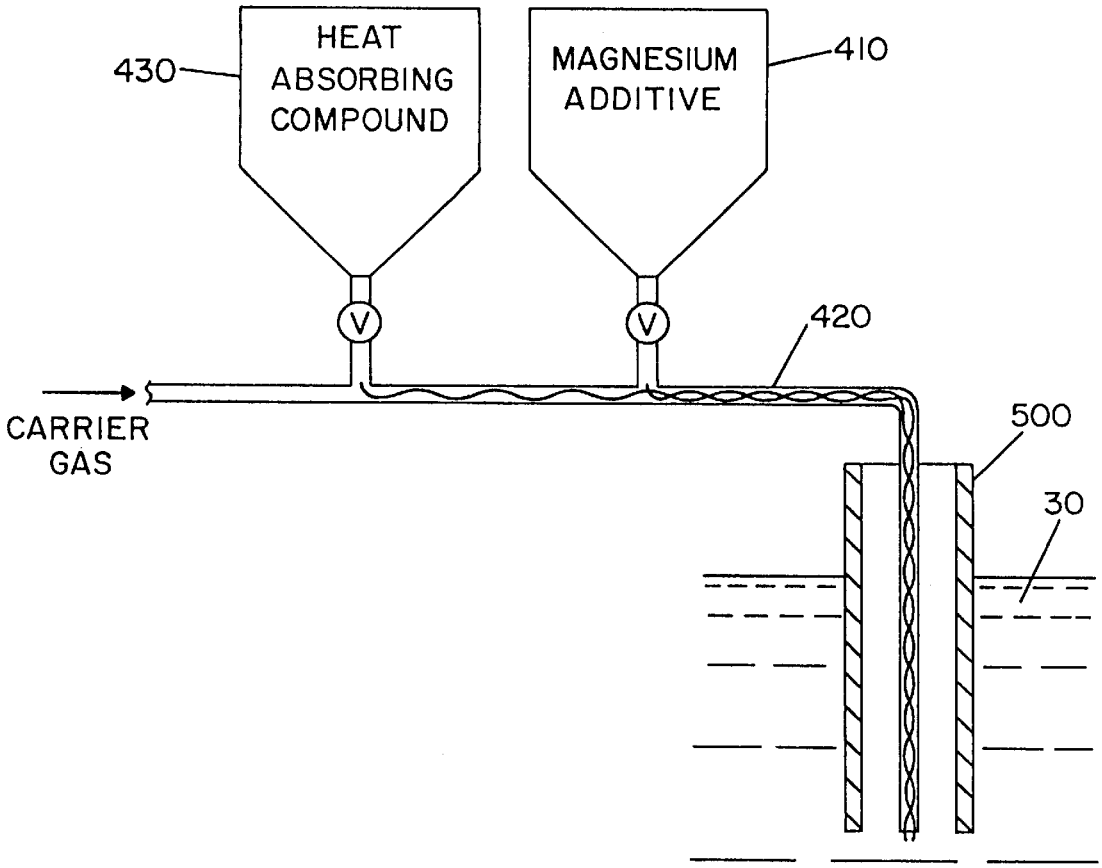
FIG. 11 is a pictorial view illustrating an alternative embodiment wherein particles of magnesium are mixed with particles of a heat absorbing compound prior to being injected into molten pig iron.

FIG. 11 illustrates another process by which the desulfurization agent can be injected into the molten pig-iron 30. In FIG. 11, particles of magnesium and particles of heat absorbing compound are combined together just prior to being injected into the molten pig-iron. Vessel 410 contains a mixture of lime and/or calcium carbide particles and particles of magnesium and vessel 430 includes a mixture of lime and/or calcium carbide particles and iron carbide and/or high carbon ferromanganese particles. The particles in vessel 430 enter line 420. The particles in vessel 410 enter line 420 where they mix with the particles from vessel 430. The particles are conveyed to the lance 500 by a carrier gas. In line 420 and lance 500, the particles are mixed together and are then injected into the molten pig iron 30. As can be appreciated, vessel 410 can contain only magnesium and vessel 430 can contain only iron carbide and/or high carbon ferromanganese.

Figure 12:
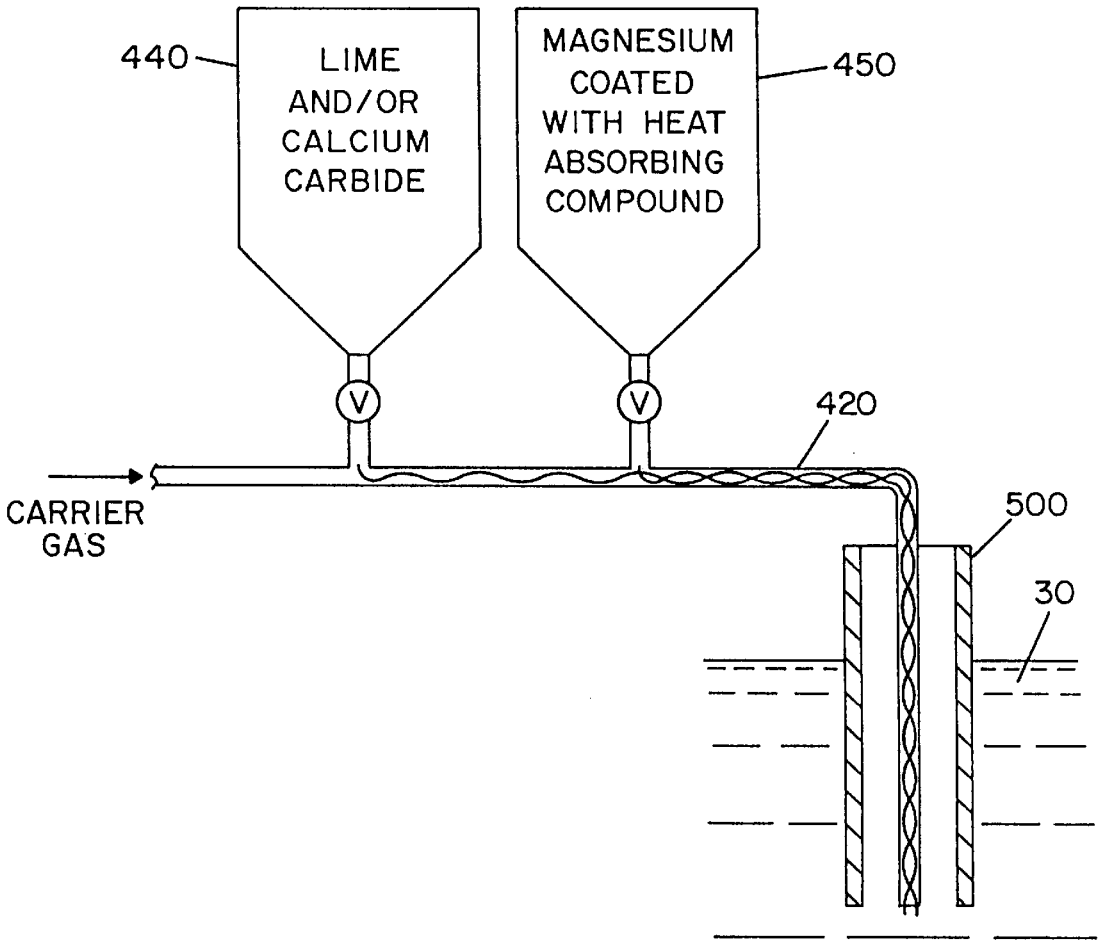
FIG. 12 is a pictorial view illustrating another alternative embodiment wherein particles of lime and or calcium carbide are mixed with particles of magnesium coated with a heat absorbing compound prior to being injected into molten pig iron.

FIG. 12 illustrates another process by which the desulfurization agent can be injected into molten pig iron 30. In FIG. 12, particles of magnesium coated with heat absorbing compound are co-injected with lime and/or calcium carbide. Vessel 440 contains a mixture of lime and/or calcium carbide and/or other compounds which enhance desulfurization or improve slag properties. Vessel 450 contains particles of magnesium coated with a heat absorbing compound. The particles in vessel 440 enter line 420. The particles in vessel 450 enter line 420 where they mix with particles from vessel 440. The particles are conveyed to lance 500 by a carrier gas. In line 420 and lance 500, the particles are mixed together and are then injected into the molten pig iron 30.

The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations in so far as they come within the scope of the appended claims.

Having thus described the invention, it is claimed:

1. A method for desulfurizing molten pig iron which comprises adding to said molten pig iron a reactive desulfurizing agent and a heat absorbing compound, said reactive desulfurizing agent being at least partially coated with said heat absorbing compound, said heat absorbing compound formulated to reduce the rate said reactive desulfurizing agent vaporizes in said molten pig iron to enhance the reaction of said reactive desulfurizing agent with sulfur in said molten pig iron, said heat absorbing compound including a compound other than a calcium compound.

2. The method as defined in claim 1, wherein said reactive desulfurizing agent includes a magnesium agent selected from the group consisting of magnesium, a solid magnesium compound, a magnesium alloy, and combinations thereof.

3. The method as defined in claim 2, wherein said magnesium agent consists essentially of magnesium.

4. The method as defined in claim 1, wherein said heat absorbing compound has a higher melting point than said reactive desulfurizing agent and a lower melting point than said molten iron.

5. The method as defined in claim 2, wherein said heat absorbing compound has a higher melting point than said reactive desulfurizing agent and a lower melting point than said molten iron.

6. The method as defined in claim 1, wherein said heat absorbing compound includes a compound selected from the group consisting of a carbide compound, a ferroalloy, and mixtures thereof.

7. The method as defined in claim 5, wherein said heat absorbing compound includes a compound selected from the group consisting of a carbide compound, a ferroalloy, and mixtures thereof.

8. The method as defined in claim 7 wherein said carbide compound includes a compound selected from the group consisting of iron carbide, high carbon ferromanganese, and mixtures thereof.

9. The method as defined in claim 1, wherein said molten iron is molten pig iron.

10. The method as defined in claim 8, wherein said molten iron is molten pig iron.

11. The method as defined in claim 1, wherein said reactive desulfurizing agent has a particle size of at least about twice the particle size of said heat absorbing compound.

12. The method as defined in claim 10, wherein said reactive desulfurizing agent has a particle size of at least about twice the particle size of said heat absorbing compound.

13. The method as defined in claim 12 wherein said reactive desulfurizing agent has a particle size of less than about 1.5 mm.

14. The method as defined in claim 13, wherein said reactive desulfurizing agent has a particle size of about 0.2–1 mm.

15. The method as defined in claim 1 wherein said heat absorbing compound has a particle size less than about 0.5 mm.

16. The method as defined in claim 14, wherein said heat absorbing compound has a particle size less than about 0.5 mm.

17. The method as defined in claim 15, wherein said heat absorbing compound has a particle size of less than about 0.11 mm.

18. The method as defined in claim 1, wherein said heat absorbing compound coats less than the complete surface area of a particle of said reactive desulfurizing agent.

19. The method as defined in claim 17, wherein said heat absorbing compound coats less than the complete surface area of a particle of said reactive desulfurizing agent.

20. The method as defined in claim 1 wherein said heat absorbing compound coats substantially the complete surface area of a particle of said reactive desulfurizing agent.

21. The method as defined in claim 17, wherein said heat absorbing compound coats substantially the complete surface area of a particle of said reactive desulfurizing agent.

22. The method as defined in claim 1, wherein said heat absorbing compound forms a blend and/or conglomeration with a plurality particles of said reactive desulfurizing agent.

23. The method as defined in claim 21, wherein said heat absorbing compound forms a blend and/or conglomeration with a plurality particles of said reactive desulfurizing agent.

24. The method as defined in claim 1, wherein said heat absorbing compound is at least partially bonded to said reactive desulfurizing agent by a bonding agent.

25. The method as defined in claim 23, wherein said heat absorbing compound is at least partially bonded to said reactive desulfurizing agent by a bonding agent.

26. The method as defined in claim 25, wherein said bonding agent includes a compound selected from the group consisting of polyhydric alcohols, polyhydric alcohol derivatives, silicon compounds, and combinations thereof.

27. The method as defined in claim 1, wherein said heat absorbing compound constitutes at least about 2 weight percent of the sum of the weight of said heat absorbing compound and said reactive desulfurizing agent.

28. The method as defined in claim 26, wherein said heat absorbing compound constitutes at least about 2 weight percent of the sum of the weight of said heat absorbing compound and said reactive desulfurizing agent.

29. The method as defined in claim 28, wherein said heat absorbing compound constitutes about 5–90 weight percent of the sum of the weight of said heat absorbing compound and said reactive desulfurizing agent.

30. The method as defined in claim 1, includes a calcium compound selected from a class consisting of calcium carbide, calcium oxide, calcium carbonate, calcium chloride, calcium cyanamide, calcium iodide, calcium nitrate, diamide lime, and calcium nitrite.

31. The method as defined in claim 19, includes a calcium compound selected from a class consisting of calcium carbide, calcium oxide, calcium carbonate, calcium chloride, calcium cyanamide, calcium iodide, calcium nitrate, diamide lime, and calcium nitrite.

32. The method as defined in claim 1, includes a volatile containing compound, said volatile compound releasing a gas product after being in contact with said molten pig iron, said gas product including a gas selected from the group consisting of oxygen compounds, nitrogen, nitrogen compounds, hydrogen, hydrocarbons, and combinations thereof.

33. The method as defined in claim 31, includes a volatile containing compound, said volatile compound releasing a gas product after being in contact with said molten pig iron, said gas product including a gas selected from the group consisting of oxygen compounds, nitrogen, nitrogen compounds, hydrogen, hydrocarbons, and combinations thereof.

34. The method as defined in claim 1, includes a slag-improvement agent, said slag-improvement agent including metallurgical fluorspar, acid grade fluorspar, dolomitic lime, silica, sodium carbonate, sodium chloride, potassium chloride, potash, cryolite, potassium cryolite, colemanite, calcium chloride, calcium aluminate, sodium fluoride, anhydrous borax, nepheline syenite, soda ash, and combinations thereof.

35. The method as defined in claim 33, includes a slag-improvement agent, said slag-improvement agent including metallurgical fluorspar, acid grade fluorspar, dolomitic lime, silica, sodium carbonate, sodium chloride, potassium chloride, potash, cryolite, potassium cryolite, colemanite, calcium chloride, calcium aluminate, sodium fluoride, anhydrous borax, nepheline syenite, soda ash, and combinations thereof.

36. The method as defined in claim 1, wherein said reactive desulfurizing agent and said heat absorbing compound are at least partially injected beneath the surface of said molten iron.

37. The method as defined in claim 35, wherein said reactive desulfurizing agent and said heat absorbing compound are at least partially injected beneath the surface of said molten iron.

38. The method as defined in claim 37, wherein said reactive desulfurizing agent and said heat absorbing compound are injected into said iron via a non-sulfur containing carrier gas.

39. The method as defined in claim 1, wherein said reactive desulfurizing agent and said heat absorbing compound are combined for injection into said molten iron, said heat absorbing compound at least partially coating said reactive desulfurizing agent during injection.

40. The method as defined in claim 38, wherein said reactive desulfurizing agent and said heat absorbing compound are combined for injection into said molten iron, said heat absorbing compound at least partially coating said reactive desulfurizing agent during injection.

* * * * *